United States Patent [19]

Monahan

[11] 4,166,321

[45] Sep. 4, 1979

[54] ORTHOGRAPHIC TO AXONOMETRIC PLOTTING APPARATUS

[76] Inventor: Brian J. Monahan, 28895 Cragmont Dr., Evergreen, Colo. 80439

[21] Appl. No.: 796,891

[22] Filed: May 16, 1977

[51] Int. Cl.[2] ..... B43L 13/14

[52] U.S. Cl. ..... 33/432

[58] Field of Search ..... 33/77, 103, 104

[56] References Cited

U.S. PATENT DOCUMENTS

| | | | |
|---|---|---|---|
| 637,857 | 11/1899 | Ditson | 33/104 |
| 821,094 | 5/1922 | Fox | 33/103 |
| 2,883,754 | 4/1959 | Luebkeman | 33/104 |
| 3,143,806 | 8/1964 | Sharp | 33/77 X |
| 3,457,648 | 7/1969 | Baudat et al. | 33/77 |
| 3,982,323 | 9/1976 | Zecevic | 33/104 X |

FOREIGN PATENT DOCUMENTS

| | | | |
|---|---|---|---|
| 276205 | 8/1927 | United Kingdom | 33/104 |

*Primary Examiner*—Charles E. Phillips

[57] ABSTRACT

Apparatus by which common points in any two conventional adjacent perpendicular orthographic views of an object are utilized to produce isometric, diametric or trimetric views of the object. One form of the apparatus comprises a main plotting member shaped at least in part in the form of an isosceles triangle, and an auxiliary plotting member shaped at least in part in the form of a parallelogram, and means for orienting the auxiliary plotting member at a predetermined angle with respect to the main plotting member. The plotting members are preferably made from rigid, dimensionally stable, transparent plastic material, and lines may be scribed on the plotting members to facilitate positioning of the plotting members for location of common points in the two orthographic views and for orienting the main plotting member with respect to the tertiary axis of the two orthographic views.

14 Claims, 8 Drawing Figures

ORTHOGRAPHIC TO AXONOMETRIC PLOTTING APPARATUS

BACKGROUND OF THE INVENTION

1. Field of the Invention

This invention relates to mechanical drafting apparatus, and more particularly to an improved drafting apparatus for deriving an axonometric view of an object from two conventional perpendicular and normally aligned orthographic views of the object. More specifically, the axonometric view may be produced as a trimetric, dimetric or isometric view with its primary, secondary and tertiary surfaces oriented at nominal angles of five degree multiples with respect to non-converging lines of sight normal to the viewing plane of the axonometric view.

2. Brief Description of Prior Art

Various devices have been developed for producing axonometric views of an object from orthographic views of the object. Exemplary of such devices are those disclosed in U.S. Pat. Nos. 3,070,894, 3,157,951, 3,296,701 and 3,457,648.

Certain important considerations should be appreciated as they relate to drafting apparatus. Drafting apparatus which is prone to introduction of error is not desirable. Any drafting apparatus which is relatively complicated in construction and use, or which requires extensive familiarization, experience or knowledge of its use, may be prone to create situations where error is likely to occur, particularly with less experienced or less skillful use. These considerations are especially applicable to drafting apparatus for producing axonometric views of an object from its orthographic views. Another important consideration with respect to axonometric drafting apparatus is the ability to selectively produce dimetric, trimetric and isometric axonometric views of the object. Selective presentations of the various axonometric views is sometimes necessary to avoid hidden or superimposed details. Another important consideration is the ability to produce the axonometric view directly from the orthographic views, without reorienting the orthographic views or without making intermediate drawings from which the axonometric drawing can then be made. Understandably, reorienting the views or making intermediate drawings increases the number of steps required to produce the resulting axonometric view, as compared to directly producing the axonometric view directly from the orthographic views.

One problem in providing an axonometric view of an object represented in two orthographic views is that of drawing representations of circles or arcs of circles in the axonometric view. Standard ellipse templets are useful for drawing representations of circles or arcs or circles, but the standard ellipse templets are typically available in five degree multiples and therefore are not always appropriate for drawing representations of circles or arcs of circles in the axonometric views unless the surfaces of the axonometric view upon which the circles or arcs of circles are to be represented are oriented at multiples of five degrees to non-converging lines or sight normal to the viewing plane of the axonometric view.

SUMMARY OF THE INVENTION

In accordance with the present invention, an improved plotting or drafting apparatus is provided for producing axonometric views of an object from any two adjacent perpendicular orthographic views of the object. The improved drafting apparatus is compact in construction and is relatively easy to use without extensive familiarization with and dependence on various adjustments of protractors or the like. Concern with reference angles is significantly reduced and the three surface angles of the resulting axonometric view are presented in nominal multiples of five degrees to allow use of standard ellipse templets for drawing representations of circles or arcs of circles on the primary, secondary and tertiary surfaces of the axonometric view. Edges or means for drawing lines parallel to all three axonometric axes are employed, and the primary guide angle is predetermined, thereby avoiding arbitrary selection of reference angles and resort to a mathematical formula or table for determining the primary guide angle.

The improved drafting apparatus of the present invention, in its preferred form, comprises a main plotting member and an auxiliary plotting member adapted to be engaged against and guided by the main plotting member. The main plotting member includes base, reference and plotting edges formed respectively parallel to the base and first and second equal sides of an isosceles triangle. The auxiliary plotting member is preferably similar in shape to a parallelogram and has two longitudinally extending side edges which define reference and plotting edges thereof, and two parallel transverse end edges oriented at predetermined angles with respect to the longitudinal side edges. Means for determining the primary guide angle of the main plotting member determined with respect to its base edge may take one form as a line formed on the main plotting member for orienting the base edge with respect to the tertiary axis of the two orthographic views. The auxiliary plotting member includes means for orienting its reference side edge at a predetermined angle with respect to the reference edge of the main plotting member, after the main plotting member has been positioned. Reference lines may be formed on the main and auxiliary plotting members for easy location of the common points on the orthographic views. Utilized in this manner, the intersection of the plotting longitudinal side edge of the auxiliary plotting member with the plotting edge of the main plotting member produces a common point on the axonometric view, and lines drawn along the plotting edge of the main plotting member, along the plotting edge of the auxiliary plotting member and along the transverse end edge of the auxiliary plotting member are parallel respectively to the primary, secondary and tertiary axes of the resulting axonometric view.

A more complete understanding of the improved orthographic to axonometric plotting apparatus, as well as other advantages and objectives of the present invention, will become apparent from the following brief description of the drawings, description of preferred embodiments and appended claims.

DESCRIPTION OF PREFERRED EMBODIMENTS

Figure 1:
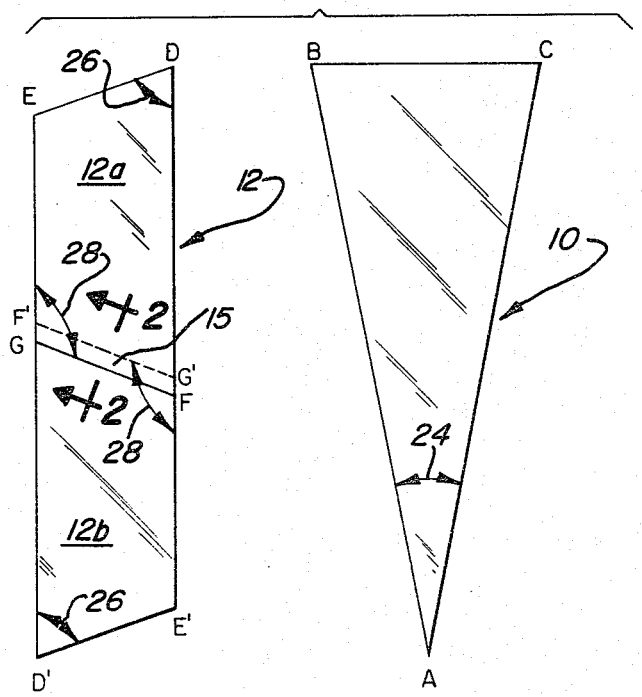
FIG. 1 is a top view of a main plotting member and an auxiliary plotting member comprising the apparatus of the present invention.

The improved plotting or drafting apparatus of the present invention is generally shown in FIG. 1 to comprise a main plotting member 10 formed with a shape characteristic of an isosceles triangle, and an auxiliary member 12 which is preferably formed with a shape characteristic of a parallelogram. The auxiliary plotting member 12 comprises means such as a lap joint 15 adapted for engaging an edge of the main plotting member 10 during use. Shown in FIGS. 5 and 6, the main and auxiliary plotting members 10 and 12 are used to produce an axonometric view 16 of, for example, a cube from two perpendicular orthographic views 18 and 20 of the cube by, in effect, transforming common points 22 from the two orthogonal views 18 and 20 to single points 22' on the axonometric view 16. The theory and principle involved in such transformation is known in the art and is disclosed in the aformentioned U.S. Pat. No. 3,070,894 to Bernier.

The main plotting member 10, as is shown in FIG. 1, comprises a base edge BC and two equal side edges AB and AC. One of the edges AB or AC defines a reference edge of the main plotting member and the other of the edges defines a plotting edge of the main plotting member, in accordance with its manner of use. The edges AB and AC intersect at a predetermined apex angle 24 at the apex of member 10.

The auxiliary parallelogram member 12, when formed in the shape of the parllelogram shown in FIG. 1, includes two parallel longitudinal side edges D'E and DE' and two parallel transverse end edges DE and D'E'. The transverse end edges DE and D'E' form predetermined angles 26 with respect to longitudinal side edges D'E and DE', respectively. One of the longitudinal side edges D'E or DE' defines a reference edge of the auxiliary plotting member and the other of the longitudinal side edges defines a plotting edge of the auxiliary plotting member, in accordance with its manner of use. It is apparent therefore that the plotting edge of the auxiliary member is one form of plotting means for defining a linear extension parallel to the longitudinal reference side edge of the auxiliary member, and that the plotting means or plotting edge of the auxiliary member extends in parallel relation to the longitudinal side reference edge of the auxiliary plotting member.

Figure 2:
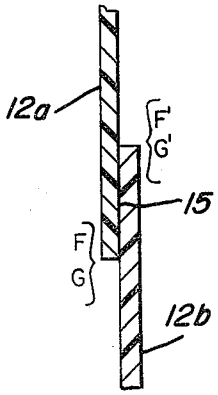
FIG. 2 is a fragmentary cross sectional view taken along section lines 2—2 of FIG. 1.

The auxiliary plotting member 12 may be formed by joining two pieces or sections 12*a* and 12*b* at the lap joint 15, as is shown in FIG. 2. The sections 12*a* and 12*b* may be generally of the same shape, with section 12*a* having edges ED, DF, FG, and GE, and with section 12*b* having edges E'D', D'F', F'G', and G'E'. Edges FG and F'G' define inner transverse edges, and when sections 12*a* and 12*b* are joined together at the lap joint 15, edge FG is parallel to edge F'G'. The inner transverse edges FG and F'G' make predetermined angles 28 with respect to the longitudinal side edges D'E and DE'. The lap joint 15 forms means for orienting or positioning edges D'E and DE' of the auxiliary plotting member at the predetermined angle 28 with respect to one of the edges AB or AC of the main plotting member 19 when used together.

The plotting members 10 and 12 may advantageously be made of rigid, transparent, dimensionally stable, plastic sheet material, such as an acrylic polymer. The sheet material construction thus provides upper and lower flat planar surfaces for both plotting members.

Figure 5:
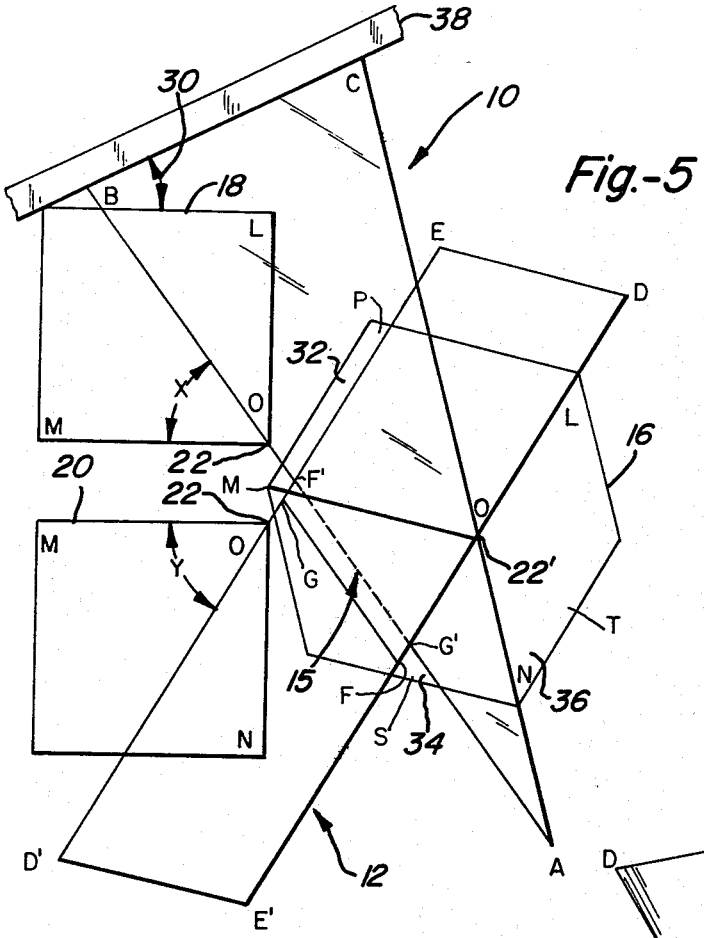
FIG. 5 is an illustration of the use of the main and auxiliary plotting members of FIG. 1 to project a trimetric view of the cube shown in FIGS. 3 and 4 from the conventional top and front perpendicular orthographic views of the cube.

When utilized, as illustrated for example in FIG. 5, the base edge BC of the main plotting member 10 is oriented at a predetermined primary guide angle 30 with respect to the tertiary axis of the orthographic view 18 and 20. In that case the tertiary axis is parallel to the horizontal lines of the orthographic views, for example, parallel to trace OM.

The values of angles 24, 26, 28 and 30 bear a direct relationship to the primary, secondary and tertiary surface angles of an axonometric view, as can be determined with the reference to FIG. 3 and from trigonometric analysis which is discussed in greater detail subsequently.

Figure 4:
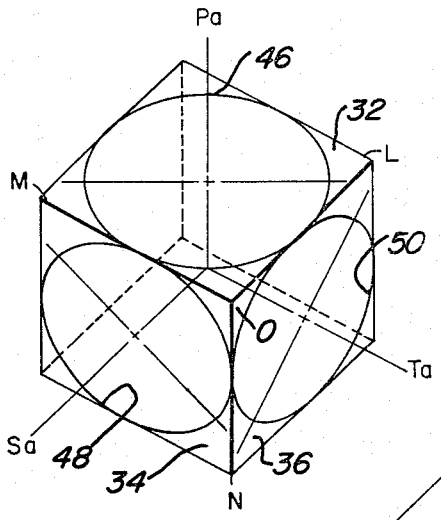
FIG. 4 is an illustration of a nominal 45°-35°-25° trimetric projection identical to the cube illustrated in FIG. 3, showing the primary, secondary and tertiary axonometric axes, with ellipses drawn in the planes of the primary, secondary and tertiary surfaces of the cube.
Figure 3:
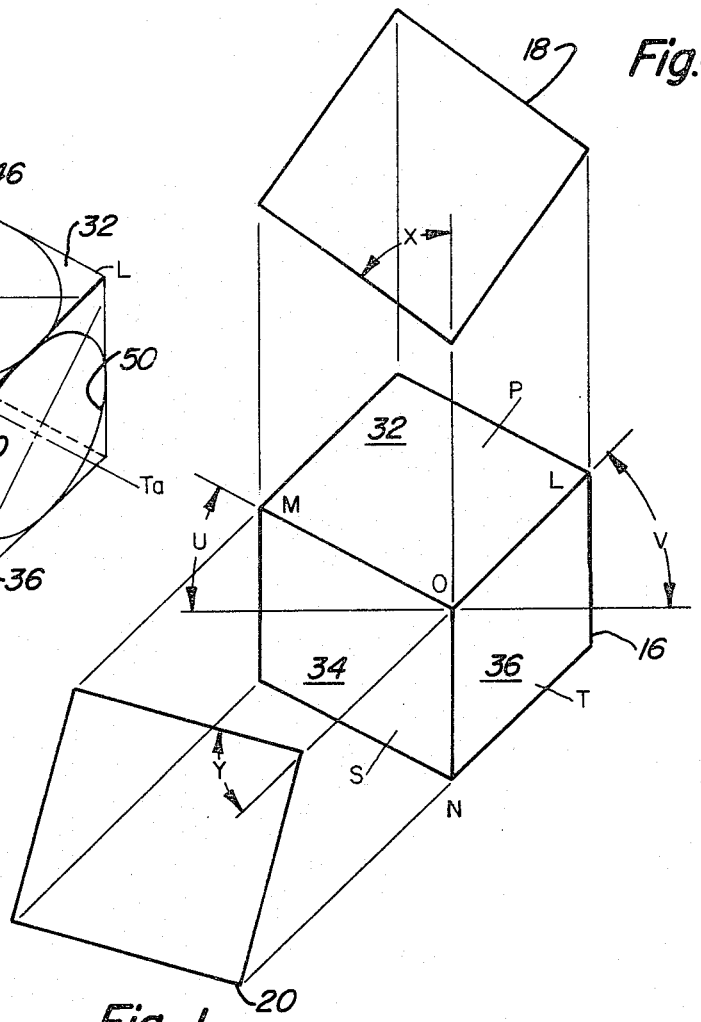
FIG. 3 is an illustration of the interrelated geometric relationships among the angles of the three surfaces of an axonometric cube, the angles of the three axonometric axes of the cube, and the reference angles of the two orthographic views of two surfaces of the cube.
Figure 6:
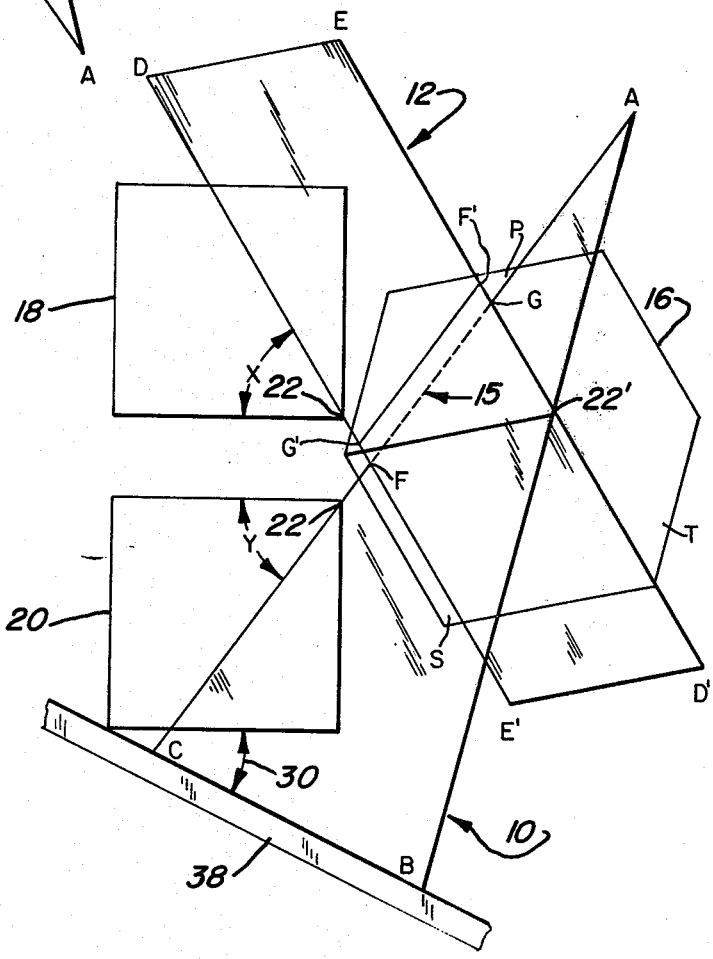
FIG. 6 is an illustration of use of the present apparatus to obtain transposition the angles of the primary and secondary surfaces of the trimetric view, the transposition being illustrated in comparison to FIG. 5.

In FIGS. 3 and 4, the primary surface 32, the secondary surface 34 and the tertiary surface 36 of the axonometric view are respectively within the planes defined by points MOL, MON and LON. The letters P, S and T designate the angles of the primary, secondary and tertiary surfaces respectively, with respect to hypothetical non-converging lines of sight normal to the viewing plane of the axonometric view 16. The three axonometric axes are shown: the primary axonometric axis Pa, normal to surface 32 and parallel to trace ON; the secondary axonometric axis Sa, normal to surface 34 and parallel to trace OL; and the tertiary axis Ta, normal to surface 36 and parallel to trace OM. The letters U and V designate the angles of the tertiary and secondary axonometric axes with respect to a horizontal line at a right angle to the primary axonometric axis in the viewing plane. The letters X and Y in FIGS. 5 and 6 represent the reference angles with respect to the tertiary orthographic axis. Reference letters L, M, N and O have been included on FIG. 5 for illustrating the relationship between the top and front orthographic views 18 and 20 and the axonometric view 16.

The values of angles 24, 26, 28 and 30 are found from the following formulas of Formula Series I:

| Formula Series I | |
|---|---|
| Trimetric: | |
| $P=\arcsin\sqrt{1-\sin^2S-\sin^2T}$ | $U=\arcsin \tan P \tan T$ |
| $S=\arcsin\sqrt{1-\sin^2P-\sin^2T}$ | $V=\arcsin \tan P \tan S$ |
| $T=\arcsin\sqrt{1-\sin^2P-\sin^2S}$ | $X=\arcsin \cos U \cos T$ |
| | $Y=\arcsin \sin(U+V)\cos T$ |
| Dimetric: | |
| $P=S=\arcsin\sqrt{\frac{1-\sin^2T}{2}}$ | $S=T=\arcsin\sqrt{\frac{1-\sin^2P}{2}}$ |
| $T=\arcsin\sqrt{1-2\sin^2P}$ | $P=\arcsin\sqrt{1-2\sin^2S}$ |
| $U=\arcsin \tan P \tan T$ | $U=V=\arctan\sqrt{1-2\sin^2S}$ |
| $V=\arcsin \tan^2P$ | $X=45°$ |
| $X=Y=\arcsin \cos U \cos T$ | $Y=\arcsin \sin 2U \cos S$ |
| Isometric: | |
| $P=S=T=\arccos\frac{\text{cube surface diagonal}}{\text{cube diagonal}}=35.264°$ | |
| $U=V=30°$ | |
| $X=Y=45°$ | |
| Angle 24 $=90°+V-X-Y$ | |
| Angle 26 $=U+V$ | |
| Angle 28 $=X+Y$ | |
| Angle 30 $=\frac{1}{2}(90°-V-X+Y)$ | |

Construction and use of the main plotting member and the auxiliary plotting member in accordance with these formulas will produce an axonometric view such as that shown in FIG. 5. In FIG. 5, a straightedge 38 is suitably secured to the drawing surface at the predetermined primary guide angle 30 with respect to the tertiary axis (parallel to OM) of the orthographic views 18 and 20. The base edge BC of the main plotting member 10 engages a straightedge 38 and is free to be guided along the straightedge 38 as is required to position the edge AB, the reference edge in this instance, above the point 22 in the orthographic view 18. The inner transverse edge F'G' of the auxiliary plotting member 12 is positioned to engage the reference edge AB of the main plotting member, and thereby set the angle of the longitudinal side edges D'E and DE' of the auxiliary plotting member with respect to the reference edge AB of the main plotting member. In this manner, the inner transverse edge F'G' defines a guided edge of the auxiliary plotting member and the reference edge AB of the main plotting member defines a guiding edge along which the guided edge F'G' moves. The auxiliary plotting member 12 is moved along the guiding or reference edge AB of the main plotting member 10 until the longitudinal side edge D'E, which is the reference edge of the auxiliary member in this instance, is positioned over the common point 22 in the second orthographic view 20. The intersection of the two plotting edges of the main and auxiliary plotting members, that is, edges AC and DE', defines the common point 22' in the axonometric view which corresponds to the same point 22 in each orthographic view 18 and 20. In this manner, a plurality of common points 22 on the two orthographic views 18 and 20 may be transformed to points 22' of the axonometric view 16 by positioning the main and auxiliary plotting members with the reference edges AB and D'E over a succession of common points on the two orthographic views while the intersection of the plotting edges AC and DE' defines the common points of the axonometric view.

Transposition of the angles of the primary and secondary surfaces P and S, respectively, in the axonometric view 16 is shown in FIG. 6, as compared to FIG. 5. The straightedge 38 is positioned at the angle 30 with respect to the tertiary axis of the orthographic views 18 and 20 and the reference and guiding edge AC, in this instance, of the main plotting member 10 is placed over the point 22 on the view 20. The auxiliary member 12 is turned about the lap joint 15 and inner transverse and guided edge FG abuts the guiding edge AC and is moved therealong until the reference longitudinal side edge DE' of the auxiliary member is positioned over point 22 on view 18. The intersection of the plotting edge AB of the main member 12 and the plotting edge D'E of the auxiliary member 12 defines the point 22' on the axonometric view 16.

Figure 7:
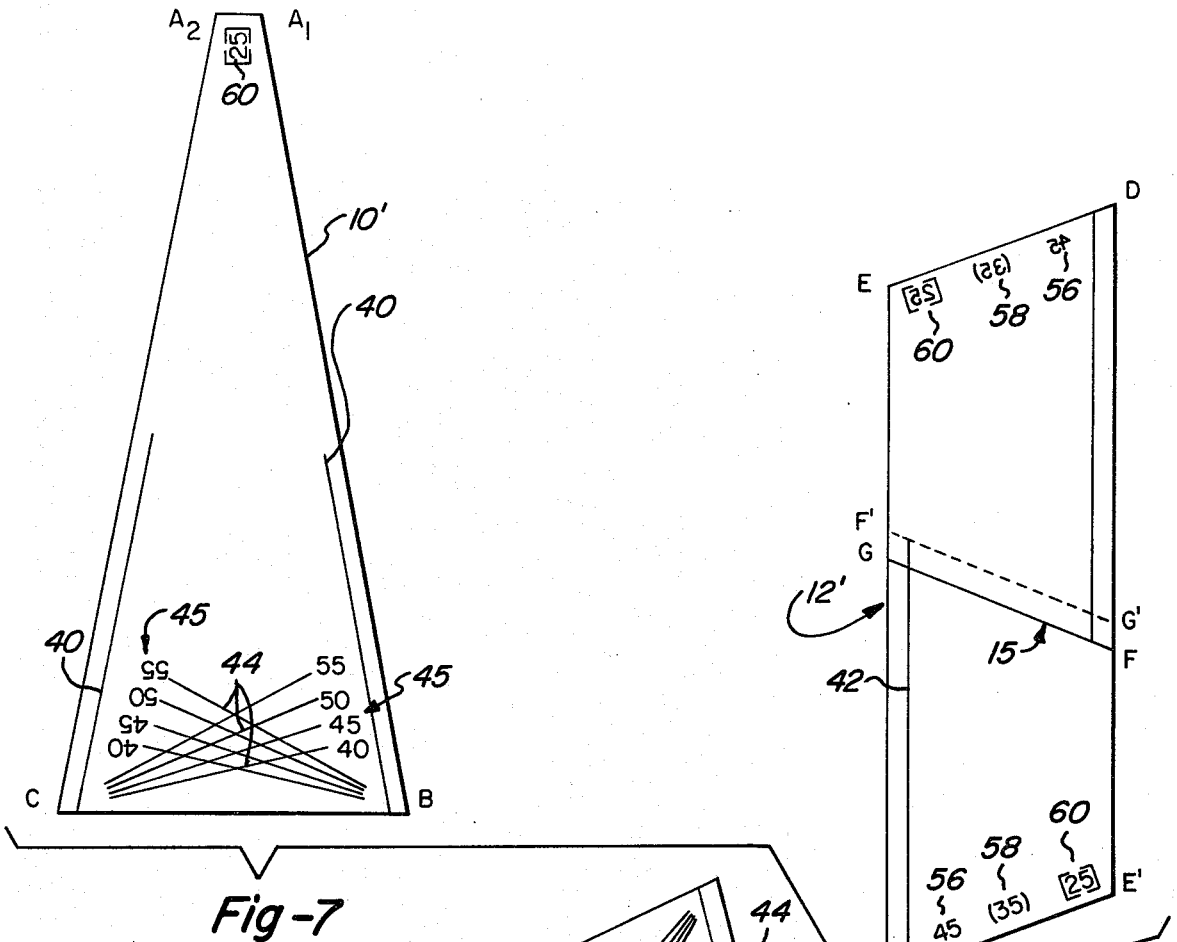
FIG. 7 is an illustration of another form of the apparatus of the present invention.

To facilitate positioning the main and auxiliary plotting members with respect to the common points on the two orthographic views, reference lines 40 and 42 are formed or scribed on an essentially transparent main plotting member 10' and on an essentially transparent auxiliary plotting member 12', as is shown in FIG. 7. Reference lines 40 are formed parallel to the plotting and reference edges $A_1B$ and $A_2C$ of the main plotting member, and the reference lines 42 are formed parallel to the reference and plotting longitudinal side edges of the auxiliary plotting member. The distance from the lines 40 and 42 to the plotting and reference edges of members 10' and 12' is any convenient optional distance to facilitate the location of a reference line over a given point in an orthographic view.

To facilitate orienting the base edge BC of the main plotting member at the predetermined angle 30 with respect to the tertiary axis of the two orthographic views, primary guide angle lines 44 are formed or scribed on the main plotting member 10'. The angle of the lines 44 with respect to the base edge BC is defined by the value of angle 30. Angular identifications at reference numeral 45 associated with each of the lines 44 as shown in FIG. 7 define the angle P of the primary surface 32 of the resulting axonometric view.

The main plotting member 10' shown in FIG. 7 is terminated prior to its apex, but extensions along edges $A_1B$ and $A_2C$ will intersect to define the apex angle. Removal of the apex portion of the main plotting member 10' has no effect on the manner of use of the plotting member, which is similar to that previously described, but merely makes the size of the member 10' more convenient for use in some instances.

Figure 8:
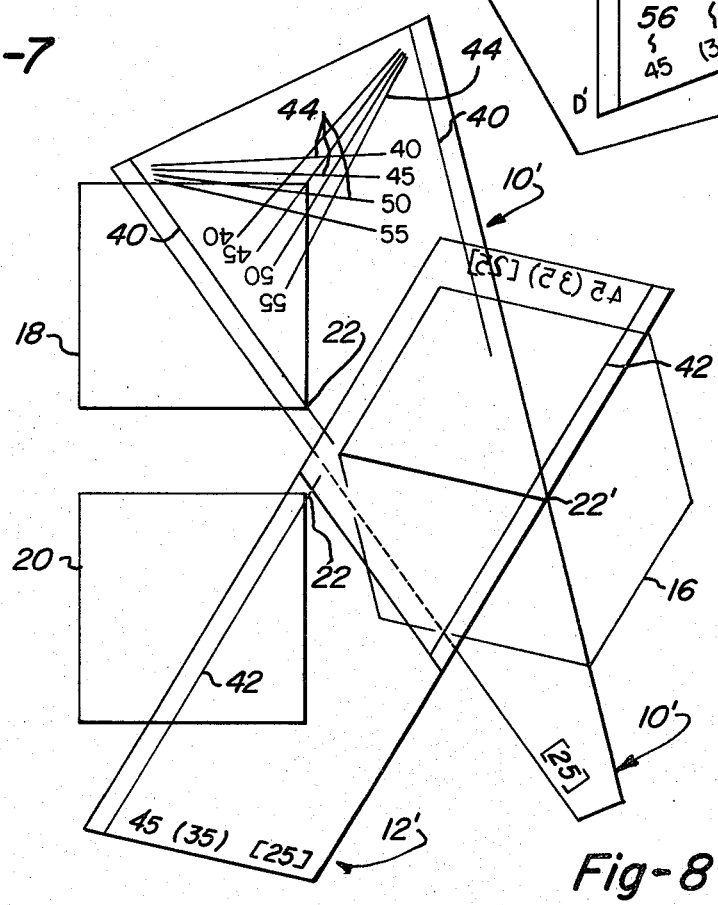
FIG. 8 is an illustration of the use of the apparatus depicted in FIG. 7 in producing an axonometric view of a cube from the conventional top and front orthographic views of the cube.

Use of the plotting members with the lines 40, 42 and 44 defined thereon is illustrated in FIG. 8. The main plotting member 10' is positioned with respect to the tertiary axis of the orthographic views 18 and 20 by means of the lines 44 while one reference line 40 is placed over a point 22 on the orthographic view 18. The guided inner transverse edge of the lap joint of auxiliary plotting member 12' is positioned to engage the reference and guiding edge of the member 10' with one reference line 42 over the common point 22 in the orthographic view 20. The intersection of the plotting edge of member 10' and the plotting longitudinal side edge of member 12' defines the point 22' on the axonometric view 16.

As seen from FIG. 5, use and construction of the main and auxiliary plotting members in the manner previously described provides the plotting edge AC of the main plotting member 10 parallel to the primary axis Pa of the axonometric view, and lines drawn along the plotting edge AC depict edges parallel to ON in the axonometric view. Similarly, the plotting longitudinal side edge DE' of the auxiliary plotting member 12 is parallel to the secondary axis Sa of the axonometric view, and lines drawn along this plotting side edge depict edges parallel to OL in the axonometric view. The transverse end edge DE of the auxiliary plotting member 12 is parallel to the tertiary axis Ta of the axonometric view, and lines drawn along the transverse end edge DE depict edges parallel to MO in the axonometric view. Utilizing the edges of the plotting members 10 and 12 allows rapid drawing of lines parallel to primary, secondary and tertiary axes.

Although the present invention may be utilized according to the foregoing description, if it is desired to employ standard ellipse templets to depict representations of circles and arcs of circles on the surfaces of the axonometric view, further calculations are necessary to determine the values of the angles 24, 26, 28 and 30. The objective in order to use standard ellipse templets is to simultaneously present the primary, secondary and tertiary surfaces at angles in nominal multiples of five degrees. However, it is known that except for the dimetric view in which the primary, secondary and tertiary surfaces appear respectively at 45°, 30° and 30°, the actual or collateral angles of the surfaces cannot be made to appear in the axonometric view at exact multiples of five degrees. However, nominal angles for the primary, secondary and tertiary surfaces of the axonometric view may be provided which minimize error and allow use of the standard ellipse templets.

The following formulas of Formula Series II were derived by substituting in the quadratic equation, and have been utilized to determine the relationship between the nominal angles of the surfaces and the collateral angles of the surfaces.

Formula Series II

When:

$$P' \neq S' \neq T',\ a = \frac{\sqrt{2(\sin P'\sin S' + \sin S'\sin T' + \sin P'\sin T' - \sin^2 P' - \sin^2 S' - \sin^2 T') + 3} - \sin P' - \sin S' - \sin T'}{3}$$

$$P' = S' \neq T',\ a = \frac{\sqrt{2(2\sin P'\sin T' - \sin^2 P' - \sin^2 T') + 3} - 2\sin P' - \sin T'}{3}$$

$$P' \neq S' = T',\ a = \frac{\sqrt{2(2\sin P'\sin T' - \sin^2 P' - \sin^2 T') + 3} - \sin P' - 2\sin T'}{3}$$

$$P = \arcsin(\sin P' + a)$$
$$S = \arcsin(\sin S' + a)$$
$$T = \arcsin(\sin T' + a)$$

In Formula Series II, P', S' and T' respectively represent the nominal angles of the primary, secondary and tertiary surfaces with respect to the non-converging lines of sight normal to the viewing plane of the axonometric view. The letter a defines the sine difference between the collateral and nominal angles.

Utilizing Formula Series II in conjunction with Formula Series I provides the values shown in Table 1.

Table 1

| Nominal Surface Angles | | | Collateral Surface Angles | | | Axonometric Axis Angles | | Orthographic Reference Angles | | Triangle Apex Angles (24) |
|---|---|---|---|---|---|---|---|---|---|---|
| | | | Angles in Decimal Degrees | | | | | | | |
| P' | S' | T' | P | S | T | U | V | X | Y | 90+V−X−Y |
| 35 | 35 | 35 | 35.264 | 35.264 | 35.264 | 30 | 30 | 45 | 45 | 30 |
| 40 | 35 | 30 | 40.171 | 35.16 | 30.151 | 29.364 | 36.485 | 48.904 | 52.094 | 25.487 |
| 45 | 30 | 30 | 45 | 30 | 30 | 35.264 | 35.264 | 45 | 54.736 | 25.529 |
| 40 | 40 | 25 | 39.891 | 39.891 | 24.908 | 22.839 | 44.322 | 56.707 | 56.707 | 20.908 |
| 45 | 35 | 25 | 44.819 | 34.844 | 24.859 | 27.413 | 43.771 | 53.655 | 59.188 | 20.928 |
| 50 | 30 | 25 | 49.593 | 29.697 | 24.71 | 32.722 | 42.064 | 49.842 | 61.234 | 20.987 |
| 55 | 25 | 25 | 54.155 | 24.461 | 24.461 | 39.029 | 39.029 | 45 | 62.941 | 21.087 |
| 45 | 40 | 15 | 45.499 | 40.46 | 15.364 | 16.236 | 60.211 | 67.79 | 69.621 | 12.8 |
| 50 | 35 | 15 | 50.48 | 35.375 | 15.318 | 19.392 | 59.394 | 65.472 | 71.096 | 12.826 |
| 55 | 30 | 15 | 55.38 | 30.251 | 15.225 | 23.218 | 57.649 | 62.469 | 72.302 | 12.879 |
| 60 | 25 | 15 | 60.163 | 25.09 | 15.085 | 28.03 | 54.721 | 58.462 | 73.3 | 12.959 |
| 65 | 20 | 15 | 64.76 | 19.891 | 14.894 | 34.346 | 50.131 | 52.93 | 74.136 | 13.064 |
| 70 | 15 | 15 | 69.039 | 14.652 | 14.652 | 43.04 | 43.04 | 45 | 74.844 | 13.197 |

Table 1-continued

| Nominal Surface Angles | | | Angles in Decimal Degrees: Collateral Surface Angles | | | Axonometric Axis Angles | | Orthographic Reference Angles | | Triangle Apex Angles (24) |
|---|---|---|---|---|---|---|---|---|---|---|
| P' | S' | T' | P | S | T | U | V | X | Y | 90+V−X−Y |
| 45 | 45 | 5 | 44.795 | 44.795 | 4.854 | 4.837 | 80.327 | 83.152 | 83.152 | 4.024 |
| 50 | 40 | 5 | 49.774 | 39.81 | 4.853 | 5.761 | 80.181 | 82.472 | 83.677 | 4.032 |
| 55 | 35 | 5 | 54.744 | 34.82 | 4.852 | 6.897 | 79.718 | 81.574 | 84.086 | 4.058 |
| 60 | 30 | 5 | 59.701 | 29.827 | 4.849 | 8.348 | 78.864 | 80.354 | 84.408 | 4.102 |
| 65 | 25 | 5 | 64.638 | 24.83 | 4.845 | 10.301 | 77.451 | 78.627 | 84.66 | 4.164 |
| 70 | 20 | 5 | 69.539 | 19.83 | 4.84 | 13.117 | 75.134 | 76.033 | 84.854 | 4.246 |
| 75 | 15 | 5 | 74.37 | 14.828 | 4.833 | 17.591 | 71.127 | 71.777 | 85 | 4.35 |
| 80 | 10 | 5 | 79.036 | 9.822 | 4.824 | 25.826 | 63.337 | 63.758 | 85.104 | 4.475 |
| 85 | 5 | 5 | 83.186 | 4.813 | 4.813 | 44.797 | 44.797 | 45 | 85.17 | 4.627 |

The present invention may be advantageously utilized according to the information of Table 1; however, to do so requires a different main plotting member for each axonometric projection, as can be understood by the different values for the apex angle 24 of the main plotting member as seen from the different values appearing in the right-hand column of Table 1. Referring to each group of projections in Table 1, each group being defined by the same nominal tertiary surface angle, it can be seen that the apex angle for each group corresponds sufficiently so that altering the collateral tertiary surface angle should result in being able to use one main plotting member with the same apex angle for each group of projections. In the groups of projections having nominal tertiary surface angles of thirty degrees and twenty-five degrees, increasing the collateral tertiary surface angles of all projections in each group except the last projection of that group will result, with the use of the following additional formulas of Formula Series III, in one apex angle for all projections in that group equal to the apex angle of the last projection in each group. In the groups of projections having nominal tertiary surface angles of fifteen degrees and five degrees, setting the difference between the sine of the collateral tertiary surface angle and the sine of the nominal tertiary surface angle of the first projection in each group equal to the difference between the sine of the nominal tertiary surface angle and the sine of the collateral tertiary surface angle in the last projection of each group, will provide one apex angle for each group to which all apex angles of each group may be adjusted. Utilization of these teachings expressed in the formulas of Formula Series III, will result in discrepancies not exceeding plus or minus 0.01 in the sines of the collateral surface angles as related to corresponding sines of nominal surface angles.

Formula Series III

When T is given and:

$P' \neq S' \neq T',\ a' = \dfrac{\sqrt{2\sin P'\sin S' - \sin^2 P' - \sin^2 S' - 2\sin^2 T + 2} - \sin P' - \sin S'}{2}$ $P' = S' \neq T',\ a' = \dfrac{\sqrt{2(1-\sin^2 T)} - 2\sin P'}{2}$ $P' \neq S' = T',\ a' = \sqrt{1 - 2\sin^2 T} - \sin P'$ $P = \arcsin(\sin P' + a')$ $S = \arcsin(\sin S' + a')$ In Formula Series III, letter a' indicates the sine difference between the collateral and nominal angles when the apex angle 24 of the main plotting member is adjusted in the manner previously described whereby one main plotting member may be utilized for each group of projections.

Results of utilizing Formula Series III and Formula Series I provides the information of Table 2 below:

Table 2

| Nominal Surface Angles | | | Angles in Decimal Degrees: Collateral Surface Angles | | | Axonometric Axis Angles | | Orthographic Reference Angles | | Triangle Apex Angles (24) |
|---|---|---|---|---|---|---|---|---|---|---|
| P' | S' | T' | P | S | T | U | V | X | Y | 90+V−X−Y |
| 35 | 35 | 35 | 35.264 | 35.264 | 35.264 | 30 | 30 | 45 | 45 | 30 |
| 40 | 35 | 30 | 40.148 | 35.139 | 30.198 | 29.4 | 36.419 | 48.849 | 52.042 | 25.529 |
| 45 | 30 | 30 | 45 | 30 | 30 | 35.264 | 35.264 | 45 | 54.736 | " |
| 40 | 40 | 25 | 39.81 | 39.81 | 25.117 | 22.999 | 44.001 | 56.457 | 56.457 | 21.087 |
| 45 | 35 | 25 | 44.741 | 34.777 | 25.043 | 27.583 | 43.485 | 53.419 | 58.979 | " |
| 50 | 30 | 25 | 49.54 | 29.657 | 24.825 | 32.845 | 41.883 | 49.686 | 61.11 | " |
| 55 | 25 | 25 | 54.155 | 24.461 | 24.461 | 39.029 | 39.029 | 45 | 62.941 | " |
| 45 | 40 | 15 | 45.437 | 40.403 | 15.595 | 16.463 | 59.795 | 67.474 | 69.328 | 12.994 |
| 50 | 35 | 15 | 50.421 | 35.329 | 15.516 | 19.623 | 59.028 | 65.175 | 70.86 | " |
| 55 | 30 | 15 | 55.335 | 30.221 | 15.359 | 23.403 | 57.39 | 62.246 | 72.15 | " |
| 60 | 25 | 15 | 60.148 | 25.081 | 15.125 | 28.096 | 54.637 | 58.387 | 73.257 | " |
| 65 | 20 | 15 | 64.797 | 19.908 | 14.815 | 34.193 | 50.31 | 53.097 | 74.22 | " |
| 70 | 15 | 15 | 69.398 | 14.407 | 14.407 | 43.108 | 43.108 | 45 | 75.114 | " |
| 45 | 45 | 5 | 44.749 | 44.749 | 5.374 | 5.351 | 79.299 | 82.422 | 82.422 | 4.455 |
| 50 | 40 | 5 | 49.724 | 39.768 | 5.362 | 6.36 | 79.16 | 81.689 | 83.017 | " |
| 55 | 35 | 5 | 54.692 | 34.784 | 5.326 | 7.563 | 78.725 | 80.759 | 83.512 | " |
| 60 | 30 | 5 | 59.648 | 29.796 | 5.266 | 9.056 | 77.92 | 79.536 | 83.929 | " |
| 65 | 25 | 5 | 64.586 | 24.806 | 5.183 | 11.006 | 76.592 | 77.848 | 84.289 | " |
| 70 | 20 | 5 | 69.493 | 19.813 | 5.078 | 13.743 | 74.422 | 75.366 | 84.602 | " |
| 75 | 15 | 5 | 74.34 | 14.819 | 4.95 | 17.996 | 70.691 | 71.357 | 84.879 | " |
| 80 | 10 | 5 | 79.045 | 9.824 | 4.802 | 25.72 | 63.447 | 63.866 | 85.127 | " |

Table 2-continued

| Nominal Surface Angles | | | Collateral Surface Angles | | | Axonometric Axis Angles | | Orthographic Reference Angles | | Triangle Apex Angles (24) |
|---|---|---|---|---|---|---|---|---|---|---|
| | | | Angles in Decimal Degrees | | | | | | | |
| P' | S' | T' | P | S | T | U | V | X | Y | 90+V−X−Y |
| 85 | 5 | 5 | 83.451 | 4.626 | 4.626 | 44.813 | 44.813 | 45 | 85.359 | " |

The present invention can thus be advantageously utilized in accordance with the information of Table 2, or values closely approximating these values, to provide the primary, secondary and tertiary surfaces of the axonometric view at nominal multiples of five degrees with respect to non-converging lines of sight normal to the viewing plane of the axonometric view. The benefit of such use is illustrated in conjunction with FIG. 4 where ellipses 46, 48 and 50, have been drawn by standard ellipse templets in the planes of the primary, secondary and tertiary surfaces 32, 34 and 36 respectively. In the case of each ellipse, the length of its major axis is equal to the length of the side of the corresponding orthographic view, the minor axis is parallel to the axonometric axis of the surface on which the ellipse appears, and length of its minor axis is equal to the length of the side of the orthographic view multiplied by the sine of the angle of the surface on which the ellipse appears. In this manner, the standard ellipse templets are easily and conveniently used to easily and accurately depict circles and arcs of circles in an axonometric view.

In Tables 1 and 2, groups of projections having a nominal tertiary surface angles of ten degrees and twenty degrees have been omitted to avoid unnecessary duplication of combinations of primary and secondary surface angles. With this arrangement, the full range of surface angles in multiples of five degrees is made available.

By utilization of the invention with any three orthographic views, six different variations of one trimetic projection can be obtained with each variation being different in transposition of its axonometric surface angles. In a similar manner, three different variations of one dimetric projection can be obtained, and one isometric projection is obtained. To obtain a number of variations of axonometric views with the surface angles in nominal multiples of five degrees, twenty-two auxiliary plotting members are used in conjunction with five main plotting members. Combinations of the five main and twenty-two auxiliary plotting members will produce one hundred and nine birds-eye exterior and interior axonometric views and the same quantity of worm-seye views depending upon the orthographic views chosen for projection.

Utilizing fine main and twenty two auxiliary plotting members in these combinations may require that the plotting members be marked or otherwise designated so that the correct two plotting members may be conveniently chosen to provide the desired axonometric view. One beneficial manner of marking the plotting members is illustrated in FIG. 7. The primary surface angle is marked at 56 at the transverse end edges of the auxiliary plotting member 12' to match the primary guide angle being used, designated at 44 and 45 on the main plotting member 10'. The secondary surface angle is marked in parentheses at 58 at the transverse end edges of the auxiliary plotting member 12'. The tertiary surface angle is marked in brackets at 60 at or near the apex of the main plotting member 10' and in brackets at 60 at the transverse end edges of the auxiliary plotting member 12'. The primary and tertiary surface angles on members 10' and 12' are matched for convenient selection of the correct combination of plotting members to provide the desired axonometric view.

It should be apparent that the various embodiments of the present invention provide an extremely effective and reliable apparatus for the projection of axonometric views. It may be that modifications can be made in the preferred embodiments of the invention described above without deviating from the broader aspects thereof.

I claim:

1. In drafting apparatus for producing an axonometric view of an object from two adjacent perpendicular orthographic views of the object, wherein a predetermined primary guide angle defined with respect to an orthogonal axis of the two orthographic views orients means for transforming common points from the two orthographic views to single axonometric points on the resulting axonometric view, an improvement comprising:

main plotting means comprising relatively straight base, reference and plotting edges, the reference and plotting edges extending in respective nonparallel and intersecting relation, the reference and plotting edges extending at the same acute angle with respect to the base edge, and extensions along the reference and plotting edges intersecting to define a predetermined acute apex angle at a point remote from the base edge; the value of said apex angle being predetermined such that upon said main plotting means being positioned with respect to the first orthographic view with the base edge extending at the primary guide angle with respect to one orthogonal axis of the two orthographic views and with the reference edge extending in predetermined relation to the common point on the first orthographic view, the plotting edge defines a linear extension along which the single axonometric point corresponding to the orthographic point is located; and auxiliary plotting means comprising at least one relatively straight longitudinal side edge, engaging means for engaging the reference edge of said main plotting means and for extending the longitudinal side edge at a predetermined intersecting angle with respect to the reference edge of said main plotting means upon engagement, and longitudinal plotting means for defining a linear extension parallel to the longitudinal side edge along which the single axonometric point is located; the value of the intersecting angle of the longitudinal side edge with the reference edge being related to the primary guide angle and the apex angle and also being predetermined such that upon said auxiliary plotting means being simultaneously positioned with respect to the second orthographic view and with the engaging means in engaging relation with the reference edge of said main plotting member and with the longitudinal side edge extending in predetermined relation to the common orthographic point on the second orthographic view, the longitudinal plotting means intersects the plotting edge of said main plotting means at a point defining the single axonometric point on the axonometric view corresponding to the common points on the two orthographic views.

2. An invention as defined in claim 1 wherein said main plotting means comprises:

a main plotting member having exterior edges enclosing said main plotting member in a geometric configuration, the exterior edges comprising the base, reference and plotting edges, said geometric member having a shape characteristic of an isosceles triangle in which the base, reference and plotting edges extend respectively parallel to the base and first and second equal sides of the isosceles triangle.

3. An invention as defined in claim 2 wherein said main and auxiliary plotting means are made of transparent sheet material, and include means defining lines extending in predetermined relation adjacent to at least one edge thereof.

4. An invention as defined in claim 2 wherein said auxiliary plotting means further comprises:

at least one relatively straight end edge extending transversely of the longitudinal side edge and extending at a predetermined intersecting angle with respect to the longitudinal side edge.

5. An invention as defined in claim 4 wherein said auxiliary plotting means comprises two parallel longitudinal side edges and two parallel transverse end edges.

6. The invention as defined in claim 4 wherein the apex angle and the primary guide angle of said main plotting means, and the intersecting angle of the longitudinal side edge of said auxiliary plotting means with respect to the reference edge of said main plotting means, and the intersecting angle of the transverse end edge with respect to the longitudinal side edge of said auxiliary plotting means are of values which simultaneously provide the primary, secondary and tertiary surfaces of the axonometric view at nominal angles of multiples of five degrees with respect to a line normal to the viewing plane of the axonometric view.

7. In drafting apparatus for producing an axonometric view of an object from two perpendicular orthographic views of the object, wherein a predetermined primary guide angle defined with respect to one orthogonal axis of the orthographic views orients means for transforming common points from the two orthographic views to single axonometric points on the axonometric view, and improvement comprising:

a main plotting means comprising relatively straight base, reference and plotting edges, respectively extending parallel to the base and the first and second equal length sides of an isosceles triangle, extensions along the reference and plotting edges intersecting to define a predetermined acute apex angle; the value of said apex angle being predetermined such that upon said main plotting means being positioned with respect to the first orthographic view with the base edge extending at the primary guide angle with respect to the tertiary axis of the orthographic views and with the reference edge extending in predetermined relation to the common point on the first orthographic view, the plotting edge defines a linear extension along which the single axonometric point corresponding to the orthographic points is located; and an auxiliary plotting means comprising at least one relatively straight longitudinal side edge, at least one relatively straight end edge extending transversely of the longitudinal side edge at a predetermined angle with respect to the longitudinal side edge, and engaging means for engaging the reference edge of said main plotting means and for extending the longitudinal side edge at a predetermined intersecting angle with respect to the reference edge of said main plotting means upon engagement; the value of the intersecting angle of the longitudinal side edge with the reference edge and the value of the intersecting angle of the longitudinal side edge with the transverse end edge being related to the primary guide angle and the apex angle and also being predetermined such that upon said auxiliary plotting means being simultaneously positioned with respect to the second orthographic view and with the engaging means in engaging relation with the reference edge of said main plotting means and with the longitudinal side edge extending in predetermined relation to the common point on the second orthographic view, the single axonometric point is defined at the intersection of the plotting edge of the said main plotting means and a linear projection parallel to the longitudinal side edge and the plotting edge of the main plotting means and the longitudinal side edge of the auxiliary plotting means extend in respective parallel relation to the primary, secondary and tertiary axes of the axonometric view produced.

8. An invention as recited in claim 7 wherein:

the apex angle is of an approximate value selected from the group of values consisting of 30.00 degrees, 25.53 degrees, 21.09 degrees, 12.99 degrees, and 4.46 degrees.

9. Apparatus for producing axonometric views from any two perpendicular orthographic views of an object, comprising a freely movable triangular main planar plotting member having parallel upper and lower surfaces, and an auxiliary generally parallelogram shaped plotting member having a bottom surface adapted to be freely positioned and movable over the upper surface of the main plotting member; said main plotting member being characterized in that it has a base edge which is slidable along guide means positioned on a drawing surface in predetermined primary guide angular relationship to orthographic views of an object to be transposed on the drawing surface, said main plotting member having a straight plotting edge and a straight reference edge which plotting and reference edges extend along non-parallel lines which intersect with the base edge at equal acute angles and which intersect with one another at a point remote from the base edge to define a predetermined acute apex angle; said auxiliary plotting member being characterized in that it has a straight engaging edge which is slidable along the reference edge of the main plotting member, said auxiliary plotting member being further characterized in that it has a straight reference edge and a straight plotting edge which are substantially parallel to one another and which extend at an intersecting angle with respect to the engaging edge thereof; said reference edge of said main plotting member being placeable so it passes over in predetermined relation to a given point on one of said orthographic views, said auxiliary member when said engaging edge thereof engages the reference edge of said main plotting member is movable therealong to a position where said reference edge passes in predetermined relation to the corresponding point on the other orthographic view, the axonometric point of said orthographic views being located at the intersection of the plotting edges of said main and auxiliary plotting members.

10. The apparatus of claim 9 wherein the auxiliary plotting member comprises two sections of sheet material which form a lap joint intermediate the opposite ends thereof to provide an engaging edge on the top and bottom surfaces of the auxiliary plotting member.

11. The apparatus of claim 9 wherein said main and auiliary plotting members are made of transparent sheet material.

12. The apparatus of claim 11 wherein said transparent members include means defining lines extending in parallel spaced relation adjacent to said reference edges thereof.

13. Apparatus for producing axonometric views from any two perpendicular orthographic views of an object comprising a triangular main plotting member having a straight base edge and two straight side edges which intersect the base edge at equal angles and which converge from their point of intersection with the base edge to define a predetermined apex angle at a point remote from the base edge, said base edge being adapted to freely slide along a straight edge positioned on a drawing surface in predetermined primary guide angular relationship to orthographic views of an object to be transposed on the drawing surface, each of said side edges useable alternately as a reference edge and a plotting edge during the plotting of an axonometric view from the orthographic views on the drawing surface; and an auxiliary plotting member adapted to be positioned on and to be freely slidable along one or the other of the side edges of the main plotting member, said auxiliary plotting member having at least two straight outer longitudinal edges forming respectively reference and plotting edges which are substantially parallel to one another and a straight intermediate edge forming an engaging edge which intersects the parallel longitudinal edges thereof, said intermediate engaging edge being adapted to engage one or the other of the side edges of the main plotting member and to be freely slidably guided therealong, said reference edge of said main plotting member being placeable so it passes in predetermined relation over a given point on one of said orthographic views, said auxiliary member when said engaging edge thereof engages the side edge of said main plotting member is movable therealong to a position where said reference edge passes over the corresponding point of the other orthographic view, the axonometric point of said orthographic views being located at the intersection of the plotting edges of said main and auxiliary plotting members.

14. In drafting apparatus for producing an axonometric view of an object from two adjacent perpendicular orthographic views of the object, wherein said drafting apparatus is of the type in which a primary guide angle defined with respect to an orthogonal axis of the two orthographic views is utilized in conjunction with means for transforming common points from the two orthographic views to single axonometric points on the resulting axonometric view, an improvement comprising:

a main plotting member having exterior edges enclosing said plotting member in a geometric configuration, the exterior edges comprising relatively straight base, reference and plotting edges, said main plotting member having the shape characteristic of an isosceles triangle with the base, reference and plotting edges extending respectively parallel to the base and first and second equal length sides of the isosceles triangle, extensions along the reference and plotting edges intersecting to define a predetermined acute apex angle; said main plotting means being positionable with respect to the first orghographic view for extending the base edge at the angle of the primary guide angle with respect to one orthogonal axis of the two orghographic views and for simultaneously extending the reference edge relative to the common point on the first orthographic view, and for further simultaneously positioning the plotting edge to define a linear extension along which the axonometric point corresponding to the orthographic point is located; and an auxiliary plotting member comprising two parallel longitudinal side edges, two parallel transverse end edges extending at a predetermined intersecting angles with respect to each longitudinal side edge, said auxiliary plotting member further comprising two sections joined together at a lap joint, each section having an inner transverse edge, and the lap joint being formed by the partial over lapping of each section at its inner transverse edge with the inner transverse edges of each section extending parallel to the one another, one inner transverse edge of said lap joint being adapted for engaging the reference edge of said main plotting member and for positioning one longitudinal side edge to extend at a predetermined intersecting angle with respect to the reference edge of said main plotting member upon engagement, the other longitudinal side edge of said auxiliary plotting means defining a linear extension along which the single axonometric point is located; said auxiliary plotting member being simultaneously positionable in engaging relation with the reference edge of said main plotting member and with respect to the second orthographic view for extending one longitudinal side edge relative to the common point on the second orthographic view, and for simultaneosly extending the other longitudinal side edge in intersecting relation with the plotting edge of said main plotting means, the intersection point defining the single axonometric point on the axonometric view.

* * * * *